United States Patent [19]

Ghahariiran

[11] Patent Number: 4,899,135

[45] Date of Patent: Feb. 6, 1990

[54] CHILD MONITORING DEVICE

[76] Inventor: Mehdi Ghahariiran, 3717 Nobel Dr. No. 1213, San Diego, Calif. 92122

[21] Appl. No.: 279,968

[22] Filed: Dec. 5, 1988

[51] Int. Cl.[4] ..... G08B 23/00

[52] U.S. Cl. ..... 340/573; 340/539

[58] Field of Search ..... 340/573, 539, 568, 687, 340/572, 574; 200/61.59

[56] References Cited

U.S. PATENT DOCUMENTS

| | | | |
|---|---|---|---|
| 3,336,530 | 8/1967 | Sloan et al. | 340/539 X |
| 3,478,344 | 11/1969 | Schwitzgebel et al. | 340/539 X |
| 3,530,451 | 9/1970 | Devine | 340/572 X |
| 4,023,138 | 5/1977 | Ballin | 340/539 X |
| 4,101,873 | 7/1978 | Anderson et al. | 340/539 |
| 4,136,338 | 1/1979 | Antenore | 340/573 X |
| 4,549,169 | 10/1985 | Moura et al. | 340/539 |
| 4,598,272 | 7/1986 | Cox | 340/539 |
| 4,675,656 | 6/1987 | Narcisse | 340/539 |
| 4,694,284 | 9/1987 | Leveille et al. | 340/574 |
| 4,736,196 | 4/1988 | McMahon et al. | 340/573 |
| 4,785,291 | 11/1988 | Hawthorne | 340/573 |
| 4,792,796 | 12/1988 | Bradshaw et al. | 340/539 |

*Primary Examiner*—Glen R. Swann, III
*Assistant Examiner*—Thomas J. Mullen, Jr.
*Attorney, Agent, or Firm*—Lewis E. Massie; Andsel Group

[57] ABSTRACT

An ultra-sonic or radio-frequency monitoring system comprising a transmitting unit carried by the child and a receiving unit carried by the child's guardian that will alert the guardian when the child strays beyond a predescribed distance, is abducted or falls into water.

1 Claim, 1 Drawing Sheet

CHILD MONITORING DEVICE

BACKGROUND OF THE INVENTION

1. Field of the Invention

This invention relates to a combination of transceivers operating in the ultra sonic frequencies used to monitor the activities of a child or The guardian's tranceiver emits a sonic warning signal whenever the child strays beyond a predetermined distance, when the child is immersed in water or when the child's transceiver is removed from the child.

2. Description of the Prior Art

Many devices have been proposed for the monitoring the location of a person carrying the device. Most of the prior art describes sophisticated radio frequency transmitters with associated receivers. U.S. Pat. No. 4,675,656 Narcisse, describes a radio frequency having a base unit transmitter that transmits a signal to a mobile receiving unit having a threshold circuit adjustable to a prescribed distance. The receiver producing a threshold output signal whenever the detected signal drops below the threshold level. U.S. Pat. No. 4,736,196 McMahon, describes a radio frequency system for monitoring the location of an individual having a band incorporating a transmitter strapped to the wrist or ankle.

SUMMARY OF THE INVENTION

The present invention employs two or more transceivers operating in the radio or ultra sonic frequency ranges. The first transceiver to be carried by the child's guardian and the second transceiver to be attached to the child. The transceiver attached to the child constantly transmits a signal to the monitoring transceiver which converts the signal and emits an audio tone. The guardians transceiver incorporates a threshold receiving circuit which causes the unit to emit an audible warning signal if the child strays, or is moved, beyond a predetermined distance, if the child is immersed in water, or if the child's tranceiver is removed from the child. A signal transmitted from the guardian's tranceiver will activate an audio alarm in the child's transceiver as an assist in locating the child.

DETAILED DESCRIPTION OF THE PREFERRED EMBODIMENT

Figure 1:
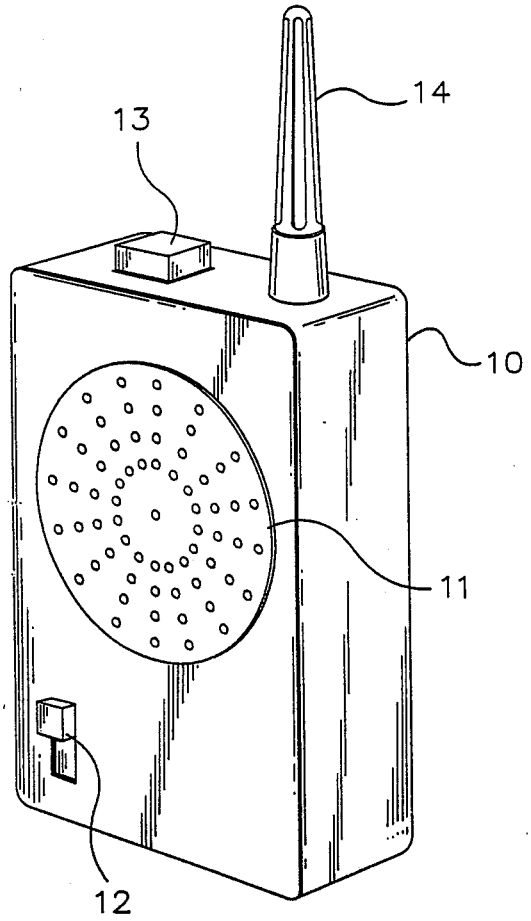
FIG. 1 is a front perspective view of the guardian's transceiver.
Figure 2:
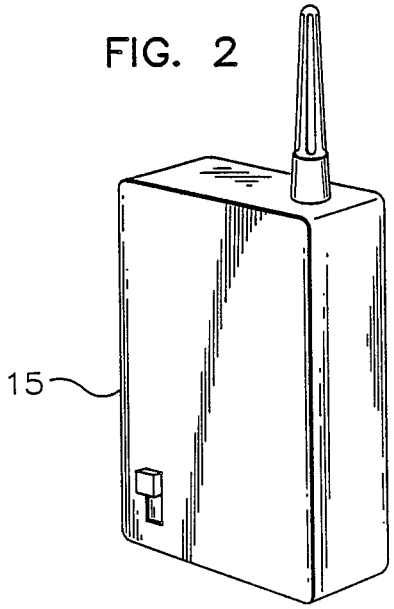
FIG. 2 is a front perspective view of the child's transceiver.
Figure 3:
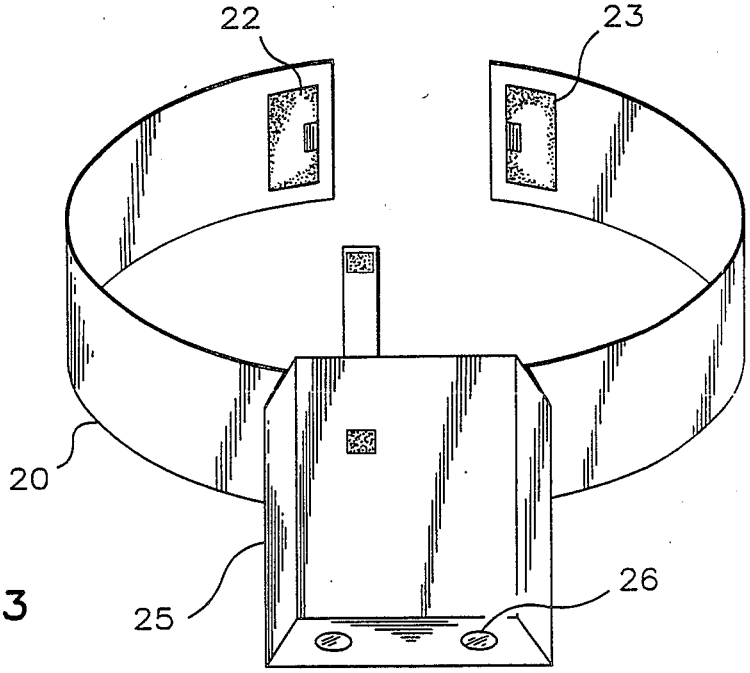
FIG. 3 is a perspective view of the child's tranceiver holster and attachment belt.

The perspective view of the guardian's transceiver unit in FIG. 1 shows the transceiver 10 with the ultra sonic emitter 14, the audio emitter 11, the combined signal light and switch 13 and the ON/OFF switch 12. Loss of received signal from the child.s tranceiver 15 will initiate an audible warning signal from the emitter 11 at which time closing the switch 13 will initiate the transmission of a signal to the child's transceiver 15 causing it to emit audible tones.

Removing the child's unit from the holster 15 opens the power supply leads through contacts 26 turning off the transmitter. Likewise removing the belt 20 by opening the VELCRO fasteners 22 and 23 opens the circuit to the power supply.

I claim:

1. A range sensitive system employing two or more ultra sonic transceivers to monitor the activities of a child, children or individuals, carrying transceivers monitored by a base transceiver carried by a guardian wherein the improvement comprises:

a, the transceivers operating in ultra sonic frequency spectrum; p1 b, the child's transceiver transmitting a constant signal which is received by the guardian's transceiver which converts the signal into an audio tone;

c, the guardian's transceiver having a threshold receiving circuit adjustable to correlate a prescribed distance from the transceiver carried by the child;

d, the loss of a signal from the child's transceiver energizing an audio generator in the guardian's tranceiver;

e, a signal from the guardian's transceiver energizing an audio tone transmitter in the child's transceiver;

f, the child's transceiver carried in a holster having means to open the transmission circuit if the transceiver is removed from the holster; and, g, the child's transceiver in the holster being attached to the child by a support belt having means to open the transmission circuit if the belt is removed from the child.

* * * * *